United States Patent [19]

Hall

[11] 4,100,516

[45] Jul. 11, 1978

[54] MICROWAVE CIRCUIT HAVING GROUNDING STRUCTURE

[75] Inventor: Roger D. Hall, Encino, Calif.

[73] Assignee: The Bendix Corporation, North Hollywood, Calif.

[21] Appl. No.: 779,128

[22] Filed: Mar. 18, 1977

[51] Int. Cl.[2] ..... H01P 5/12; H01P 1/00

[52] U.S. Cl. ..... 333/6; 333/84 M

[58] Field of Search ..... 333/12, 84 R, 84 M, 333/6, 73 S

[56] References Cited

U.S. PATENT DOCUMENTS

| | | | |
|---|---|---|---|
| 3,553,409 | 1/1971 | Lehrfeld | 333/84 M X |
| 3,560,884 | 2/1971 | Moore et al. | 333/73 S X |
| 3,870,974 | 3/1975 | Ohlstein et al. | 333/12 |

*Primary Examiner*—Paul L. Gensler

*Attorney, Agent, or Firm*—Robert C. Smith; William F. Thornton

[57] ABSTRACT

A microwave diplexer circuit consists of a stripline conductor carried between two dielectric substrate members, each having a conductive layer serving as a ground plane on its side nonadjacent to the stripline. The substrate members are enclosed in a housing of conductive material including a bottom which contains the substrate members and the stripline conductor, and a top which is fastened to the bottom to make an enclosed unit wherein the housing makes electrical contact with the ground planes. The stripline is formed with a pair of extensions in the form of grounding tabs which extend into small chambers not occupied by the substrate members. In the particular circuit shown, the circuit adjacent the grounding tabs is a high frequency microwave filter including a plurality of stubs. A shorting bar in each of the chambers overlies the tabs and is clamped to the wall of the chamber such that it defines a short at the desired length of each of said plurality of tuning stubs forming the filter. One edge of the shorting bar is of such height that it projects slightly above the chamber. The top housing member includes a slot facing the interior in registry with the projecting edge and filled with conductive rubber such that when the top is fastened to the bottom the edge projects into and penetrates the conductive rubber. This assures a good short or ground from the edge of the shorting bar to the housing and, therefore, to the ground planes.

8 Claims, 3 Drawing Figures

MICROWAVE CIRCUIT HAVING GROUNDING STRUCTURE

BACKGROUND OF THE INVENTION

Effective and practical methods for providing the required short circuits for waveguide and coaxial transmission systems have existed for many years; however, for microwave printed circuit or stripline systems using dielectric substrate support for the printed circuit, totally satisfactory methods are not as yet in general use.

Basically the stripline circuit in its simplest configuration consists of two layers of dielectric substrate material having copper ground planes on their nonadjacent sides, the dielectric substrate materials being passed tightly together with a printed circuit or stripline transmission circuit interposed between. To short such a transmission line at microwave frequencies, it is necessary to completely ground the transmission line to each of the spaced ground planes fastened to the dielectric substrates.

A number of techniques have been or are being used to ground the transmission line to the ground planes or to a metallic housing. One common techique is to solder a tab onto a printed circuit or stripline conductor which is placed between two dielectric substrates having ground planes on their opposite sides. This tab, which extends beyond the substrate members, is clamped under a shorting bar and screwed down or otherwise fastened tightly to the conductive housing. The shorting bar is then held down by the housing cover, it being of such height that the cover exerts a substantial force against it as it is secured. The difficulty with this arrangement is that air gaps tend to be formed adjacent the tab which is soldered to the stripline or printed circuit and also between the ground plane and the cover adjacent the shorting bar. Another technique which has been used is to solder a somewhat elongted tab to the transmission line, wrapping it around and soldering it down to one of the ground planes on the opposite sides of the dielectric substrate. An additional copper layer is then soldered to this wrap and also to the opposite dielectric substrate. Again, this arrangement ususally results in an undesirable air gaps between the substrates caused by the thickness of the tab soldered to the conductor. A further problem with this arrangement is that there is no means associated with this arrangement for positively controlling the position of the substrate and conductor within the support chassis. An additional problem is that since this results in a bonded or sealed assembly, the maintenance of the associated circuitry becomes more difficult. A further arrangement involves riveting the substrates together with rivet heads soldered to each of the ground planes on opposite sides thereof and with an additional inside washer soldered to the transmission line and to the rivet. With this arrangement, the electrical location of the short is not accurately predictable. There is also a high leakage of microwave fields, and the performance is generally very poor at frequencies above 10 GHz.

In addition to the above, there are also substantial problems in producibility or repeatability in production rising out of the above techniques. These problems become quite severe when operating at frequencies above 10 GHz. For example, it will be appreciated by those skilled in the art that in the manufacture of microwave filters using tuning stubs at this frequency range, it is necessary that the shorts or grounds be precisely and predictably located since very small variations in effective tuning stub length will result in altering of the frequency characteristics of the filter.

SUMMARY OF THE INVENTION

The inventor has devised a stripline circuit and a method of grounding or shorting the same which avoids the above problems, resulting in a closed microwave stripline circuit with reliable shorts at predictable locations, good serviceability and excellent producibility. The specific circuit for which my invention has been devised is a microwave frequency diplexer; however, those skilled in the art will recognize that its teachings are just as applicable to multiplexers and other microwave circuits operating in the microwve frequency range, especially those using microwave filters or tuning stubs.

I form a stripline circuit which is chemically milled or otherwise formed to the desired dimensions and which is then placed on a dielectric substrate. The substrate may have printed circuit conductor tracks which are in contact with the stripline, and such tracks are a usual method of making contact at the connectors. These connections may be soldered or may be sufficiently secure when an upper dielectric substrate is clamped tightly against the stripline. Both substrates whose nonadjacent sides have conductive layers serving as ground planes and the stripline are placed in a housing designed to just accommodate them plus one or more shorting tabs formed with the stripline and which extends beyond the substrates into a space or chamber in the housing. One or more shorting bars are secured and clamped in position over the tabs with the shorting bars having a wall or edge of slightly greater height than that of the chamber. A cover for the housing has inserts of a conductive elastomer such as silver-impregnated synthetic rubber, which inserts are in registry with the edges of the shorting bar or bars so that when the cover is tightly secured to the housing the shorting bar wall or edge penetrates somewhat into the conductive elestomer, making electrical contact with it and, hence, with the entire housing. The location of the short is thus quite predictable as coinciding with the edge of the shorting bar, and where such bar is used to terminate a series of tuning stubs, the electrical characteristics are thereby precisely determined. No undesirble air gaps are caused by the requirement that the shorting bar be high enough to make good electrical contact with the chassis cover, nor because a tab must be soldered to a printed circuit track under the cover.

DESCRIPTION OF THE PREFERRED EMBODIMENT

Figure 1:
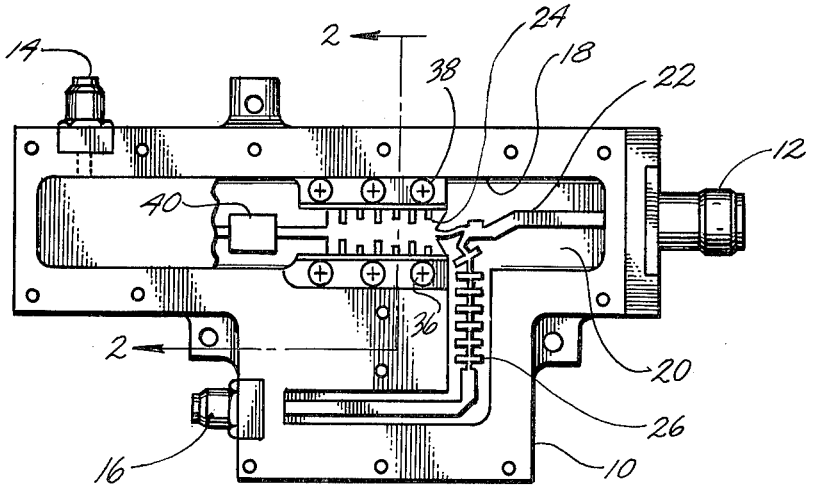
FIG. 1 is a plan view of a microwve diplexer incorporating my invention with the cover and the upper dielectric substrate removed.

Referring now to FIG. 1, a chassis in the form of a metal housing 10 is shown having an inlet port 12 and outlet ports 14 and 16. The unit shown is a diplexer whose function is to divide input signals ranging over a frequency from 2 GHz to 18 GHz into two separate bands. Thus, the housing has an interior chamber 18 which is dimensioned to receive a substrate 20 of dielectric material. The conductor 22, which is preferably chemically milled of 1.5 mil or smaller beryllium shim stock, is laid on the dielectric member 20 and is secured between this member and a similar member located on top of the conductor 22. It will be observed that conductor 22 divides into two sections, a first section 24 constituting a high frequency microwave filter section and a second 26 which is designed to pass frequencies of a lower frequency band such as 2 GHz to 10 GHz. This lower frequency band of signals is then conducted directly to the output port 16.

Figure 2:
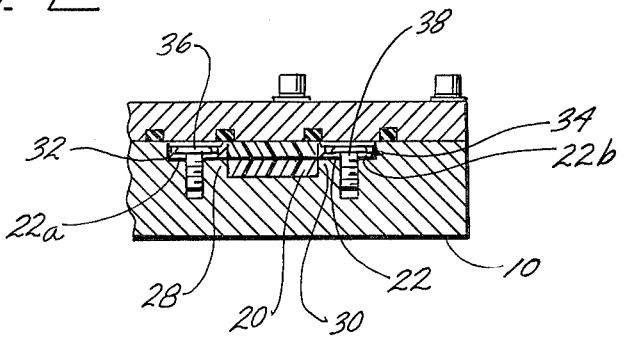
FIG. 2 is a partial sectional view taken along lines 1—1 5 of FIG. 2, but with the cover and upper dielectric substrate in place.

Referring now to the sectional view, FIG. 2, it will be observed that housing member 10 includes, in addition to the opening 18 for receiving the substrate 20, a pair of steps 28 and 30 of essentially the same height or thickness as the substrate 20, a part of which is located between said steps. Conductor 22, which for the most part lies directly over the substrate 20, also including shorting tabs **22*a* and 22*b* which overlie the steps 28 and 30, respectively. Overlying the shorting tabs 22*a* and 22*b* are a pair of shorting bars 32 and 34, respectively, and each of these tabs is firmly grounded on its corresponding step by means of one of screws 36 and 38. From consideration of FIG. 1, it will be apparent that there are actually three each of screws 36 and 38 shown anchoring the somewhat elongated tabs 22*a* and 22*b*. It is the function of the high frequency filter section shown at numeral 24 to pass frequencies of a known band to the detector section 40 which, after detection, supplies a video signal to outlet port 14**.

Figure 3:
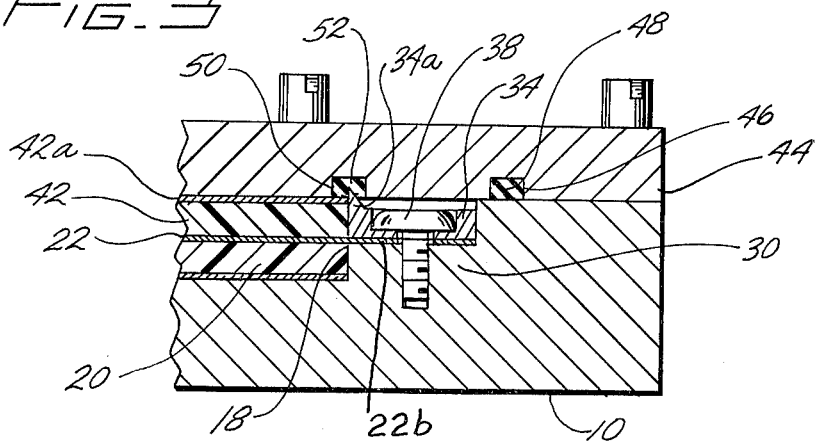
FIG. 3 is a partial view of the structure of FIG. 3 enlarged to show detail.

The details of the invention may be more clearly understood from consideration of FIG. 3, which is an enlarged view of a portion of FIG. 2, Again, it will seen that housing 10 consists of a chamber 18 receiving a substrate 20 positioned next to the step 30 of essentially the same height. The conductor 22 overlies the substrate 20, and its tab **22*b* overlies the step 30. The shorting bar 34 which overlies the tab 22*b* is shown as having the wall or edge 34*a* of greater height than the part of opening 18 above step 30, which height is also essentially the same as that of the upper substrate member 42. The cover 44 of housing member 10 includes a groove 46 containing a seal 48 whose function is to prevent moisture, etc. from reaching the circuits inside of housing 10. Cover 44 also includes another groove 50 containing a member 52 of conductive rubber, which directly registers with the edge 34*a* of shorting bar 34. As shown, edge 34*a* is of such height that when cover 44 is installed, this edge penetrates the conductive rubber member 52, thereby providing a conductive path from the shorting tab 22*b* through edge 34*a* to conductive rubber member 52 and hence to the housing itself. It will also be observed that substrate members 20 and 42 each include a thin layer of conductive material such as copper on their nonadjacent sides and which are held in direct contact with housing 10 and cover 44**, respectively, and serve as ground planes for the microwave circuit.

Since the depth of chamber 18 and the height of the step 30 are chosen to just accommodate the heights of substrate members 20 and 42 (and the stripline conductor 22), fastening of the cover 44 puts conductor 22 and the substrate members in compression, avoiding the creation of air gaps. The location of the short is clearly defined at the edge of the step 30, and thus the effective lengths of the tuning stubs in the high frequency microwave filter 24 are clearly defined.

While the invention herein has been described in terms of a diplexer, it will be apparent that invention is applicable to design of many microwave circuits. Applicant's system teaches means providing a complete short ground plane to ground plane, a circuit board assembly without air gaps at critical electrical locations, and an arrangement whereby assembly may be effected without critical mechanical tolerance controls. Thus, the arrangement shown herein makes possible good producibility of such circuits. The stripline circuit in many, if not most, cases can be formed of a self-supporting piece of stock for easy handling. In forming the circuit 22, for example, some thin supporting strips are formed between the outboard end of the low frequency section communicating with outlet port 16 and the shorting tabs **22*a*. These, of course, are removed in production. Also, as indicated above, it is frequently useful to form part of the circuit as a printed circuit on the surface of one of the dielectric substrate members with the chemically milled circuit making contact with the printed circuit conductor either through soldering or through the compressive force necessarily resulting when the cover 44 is pulled down onto chassis 10**.

I claim:

1. In a microwave stripline circuit including two adjacent dielectric substrate members having conductive ground planes on their nonadjacent surfaces;

a chassis of electrically conductive material enclosing said substrate members in contact with said ground planes, said chassis including two members and means for fastening said chassis members, together, an internal chamber being formed in said chassis adjacent said substrate members, one of said chassis members having a length of conductive elastomeric material in its surface facing said chamber, a stripline conductor positioned between the adjacent surfaces of said dielectric substrate members having an extension into said chamber, and means for securing said extension tightly against a wall of said chamber, said means including a shorting bar having a projection of slightly greater length than the height of said chamber such that said projection penetrates said conductive elastomer when said chassis members are fastened together.

2. A microwave stripline circuit as set forth in claim 1 wherein said stripline conductor includes a chemically milled strip of metal stock.

3. A microwave stripline circuit as set forth in claim 1 wherein one of said substrate members includes a prined circuit conductor and said stipline conductor is electrically connected to said printed circuit conductor.

4. A microwave stripline circuit as set forth in claim wherein said stripline circuit defines a microwave frequency multiplexer comprising a high frequency filter section having a plurality of stub elements connected to said extension, said shorting bar being positioned on said extension to control the effective length of said microwave stub elements.

5. A microwave stripline circuit as set forth in claim 1 wherein said stripline circuit defines a microwave diplexer including first filter means tuned to a lower band of frequencies and a second filter means tuned to a higher band of frequencies, said higher frequency filter means including a plurality of microwave stubs connected to said extension, said shorting bar being positioned on said extension to control the effective length of said microwave stubs.

6. In a microwave stripline circuit including two adjacent dielectric substrate members with conductive ground planes positioned on their nonadjacent surfaces, a chassis of electriacally conductive material enclosing said substrate members in contact with said ground planes, said chassis including top and bottom members and means fastening said chassis members together, said chassis members being dimensioned to provide a small chamber extending beyond said substrate members and having a surface approximately level with the adjacent surfaces of said dielectric substrate members, said top member incorporating a length of conductive eleastomeric material facing said chamber;

a stripline conductor positioned between the adjacent surfaces of said dielectric substrate members having an extension into said chamber over said surface, and a shorting bar in said chamber and fastening means forcing said bar and said extension against said surface, said shorting bar including a projection of slightly greater length than the height of said chamber such that when said chassis members are fastened together said projection is forced into said conductive elastomeric material, thus grounding said conductor to said chassis.

7. A method of manufacturing a microwave stripline circuit which includes two adjacent dielectric substrate members having conductive ground planes on their nonadjacent surfaces, a chassis of electrically conductive material including two members forming an opening enclosing said substrate members in contact with said ground planes and including means fastening said chassis members together, and a conductor positioned between said dielectric substrate members including the steps of (a) forming said chassis with an internal chamber positioned beside said substrate members, (b) forming said conductor as a stripline member with an extension into said internal chamber, (c) forming a shorting bar of such height that it is contained within said internal chamber and having an edge extending slightly above the height of said chamber and fastening said shorting bar and said extension to a wall of said chamber, (d) forming one of said chassis members with an insert of conductive elastomer in registry with said edge, and (e) fastening said chassis members together such that said edge penetrates said conductive elastomer.

8. A method of manufacturing a microwave stripline circuit as set forth in claim 7 wherein part of said opening formed by one of said chassis members is of exact size to contain one of said substrate members and an additional part of said opening is of substantially the height of said other substrate member and of greater area to provide said chamber.

* * * * *